US012234609B2

(12) United States Patent
Faucher et al.

(10) Patent No.: US 12,234,609 B2
(45) Date of Patent: Feb. 25, 2025

(54) METHOD FOR MANUFACTURING PAPER AND CARDBOARD

(71) Applicant: SNF GROUP, Andrezieux Boutheon (FR)

(72) Inventors: Gatien Faucher, Andrezieux Boutheon (FR); Damien Fougerouse, Andrezieux Boutheon (FR)

(73) Assignee: SNF GROUP, Andrezieux Boutheon (FR)

( * ) Notice: Subject to any disclaimer, the term of this patent is extended or adjusted under 35 U.S.C. 154(b) by 275 days.

(21) Appl. No.: 18/006,280

(22) PCT Filed: Jun. 24, 2021

(86) PCT No.: PCT/FR2021/051158
§ 371 (c)(1),
(2) Date: Jan. 20, 2023

(87) PCT Pub. No.: WO2022/023631
PCT Pub. Date: Feb. 3, 2022

(65) Prior Publication Data

US 2023/0295877 A1 Sep. 21, 2023

(30) Foreign Application Priority Data

Jul. 30, 2020 (FR) ..... 2008078

(51) Int. Cl.
*D21H 21/10* (2006.01)
*D21H 17/00* (2006.01)
(Continued)

(52) U.S. Cl.
CPC ..... *D21H 21/10* (2013.01); *D21H 17/43* (2013.01); *D21H 17/455* (2013.01);
(Continued)

(58) Field of Classification Search
CPC ..... D21H 21/10; D21H 17/43; D21H 17/455; D21H 17/66; D21H 17/675; D21H 17/74; D21H 23/06; D21H 17/34; D21H 21/52
See application file for complete search history.

(56) References Cited

U.S. PATENT DOCUMENTS

2013/0139986 A1* 6/2013 Faucher ..... D21H 17/42
162/168.3

FOREIGN PATENT DOCUMENTS

WO WO-2006071175 A2 * 7/2006 ..... D21H 17/72
WO 2012/017172 A1 2/2012

OTHER PUBLICATIONS

International Search Report and Written Opinion of International Application No. PCT/FR2021/051158, mailed on Oct. 20, 2021, 17 pages. Full translation.

* cited by examiner

*Primary Examiner* — Abbas Rashid
*Assistant Examiner* — Matthew M Eslami
(74) *Attorney, Agent, or Firm* — HESLIN ROTHENBERG FARLEY & MESITI P.C.

(57) ABSTRACT

This invention relates to a method for manufacturing a sheet of paper or cardboard, comprising the addition of a water-soluble polymer P with a weight-average molecular weight greater than 750,000 Dalton to a fibrous suspension. This method comprises the following successive steps:

preparing an aqueous solution A containing at least one water-soluble polymer P at a concentration C of between 0.1 and 0.5% by weight, said polymer P having a factor F(C) strictly greater than 4, with $F_{(C)}=\Delta 600/C$, Δ600 being the slope to reach 90% of the viscosity developed by aqueous solution A at 600 seconds at 25° C., obtained from the viscosity curve of aqueous solution A as a function of time, at the given concentration C, at 25° C., (Continued)

adding aqueous solution A to the fibrous suspension, at one or more injection points, forming a sheet of paper or cardboard.

20 Claims, 2 Drawing Sheets

(51) Int. Cl.

| | |
|---|---|
| ***D21H 17/43*** | (2006.01) |
| ***D21H 17/45*** | (2006.01) |
| ***D21H 17/66*** | (2006.01) |
| ***D21H 17/67*** | (2006.01) |
| ***D21H 23/06*** | (2006.01) |

(52) U.S. Cl.

CPC ..... *D21H 17/66* (2013.01); *D21H 17/675* (2013.01); *D21H 17/74* (2013.01); *D21H 23/06* (2013.01)

METHOD FOR MANUFACTURING PAPER AND CARDBOARD

CROSS REFERENCE TO RELATED APPLICATIONS

This application is a national stage filing under section 371 of International Application No. PCT/FR2021/051158 filed on Jun. 24, 2021, and published on Feb. 3, 2022, as WO 2022/023631, which claims priority to French Application No. 2008078, filed on Jul. 30, 2020. The entire contents of WO 2022/023631 are hereby incorporated by reference herein.

TECHNICAL FIELD OF THE INVENTION

This invention relates to a method for manufacturing paper and cardboard with improved total retention, filler retention, and dewatering properties, and/or superior mechanical paper/cardboard characteristics. More specifically, the subject-matter of the invention is a manufacturing process involving the prior preparation of a stock solution of at least one water-soluble polymer with specific dissolution properties before its addition to the fibrous suspension.

This invention also relates to the paper and cardboard obtained by this method.

PRIOR ART

The implementation of retention and dewatering systems is well known in papermaking processes. The term, retention properties, is to be understood as the ability to retain the suspension of materials within the paper pulp (fibers, fillers (calcium carbonate, titanium oxide, . . . ), . . . ), on the forming fabric, therefore in the fibrous mats which will constitute the final sheet. The retention agents' mode of action is based on the flocculation of these materials in suspension in water. Indeed, the flocs formed are more easily retained on the forming fabric.

The retention of fillers consists in specifically retaining the fillers (mineral species of small size presenting little affinity with cellulose). The significant improvement in filler retention leads to a clarification of white water by retaining the fillers in the sheet of paper as well as increasing its weight. This also provides the possibility of substituting part of the fibers (the most expensive component in the composition of the paper) with fillers (lower costs) to reduce the manufacturing costs of the paper.

With regard to the dewatering (or drainage) properties, this is the capacity of the fibrous mat to evacuate or drain the maximum amount of water so that the sheet dries as quickly as possible, in particular during its manufacture.

These two properties (retention and drainage) are intimately linked, one depending on the other. It is then a matter of finding the best compromise between retention and drainage. In general, those skilled in the art refer to a retention and drainage agent because these are the same types of products which make it possible to modulate these two properties.

All the retention and drainage systems known in the prior art are characterized by the fact that their main retention agent is water-soluble polymers of high molecular weight, greater than 1 million g/mol, usually more than 3 million g/mol, called flocculants. They are generally cationic and have the particularity, due to their high molecular weight, of being able to take the form of an emulsion (inverse), an oily suspension (distilled inverse emulsion), a microemulsion, or a powder. These polymers are generally introduced at a level of 50 to 800 g/t of dry polymer compared to dry paper. The points of introduction of these agents in the paper process are generally located in the short circuit, that is to say after the fan pump, and therefore in thin stock whose concentration is most often less than 1%, more generally between 0.5 and 1.2%, by weight of dry matter.

Whatever the physical form of the water-soluble polymer (powder, emulsion, oily suspension), it is necessary to prepare a stock solution (aqueous) of water-soluble polymer beforehand for its injection into the papermaking process. However, the maximum viscosity of this stock solution can only be reached after several minutes, even tens of minutes, which implies a prolonged residence time of the water-soluble polymer in the stock solution preparation unit, with a volume of high maturation preparation tank and therefore a large footprint within the paper mill.

WO 2006/071175 describes a composition and its use in the manufacture of paper. This composition comprises a polymer and a hydrocarbon compound (oil, fat, or wax). During papermaking, it can be added directly to a fiber suspension or after being emulsified. It is not used to form an aqueous solution before its addition to a fiber suspension. It can also be applied to the sheet of paper.

In addition to retention and drainage agents, papermaking processes may also involve sheet strength agents, in the dry state and/or in wet condition.

Some dry strength agents are water-soluble polymers with an average molecular weight of at least 750,000 Daltons and may be in powder or inverse emulsion form. As a result, these products have the same drawbacks with regard to their preparation time. This is all the more true as the dosages of additives introduced into the paper pulp are on the order of 500 to 5000 g/t of dry matter (generally cellulosic fibers+ fillers). The rapid dissolution of these polymers is therefore a key factor in reducing the footprint of preparation units.

DISCLOSURE OF THE INVENTION

Unexpectedly, the Applicant has discovered that a papermaking process using an aqueous solution A containing at least one water-soluble polymer P at a concentration by weight C of between 0.1 and 0.5% by weight, makes it possible to achieve drainage performance, fiber and fines retention, filler retention, or mechanical characteristics of the papier/carton improved in comparison to the other forms of products after two minutes, or less, of preparation at 25° C., which implies that the dissolution time of polymer P is reduced. Polymer P has a factor $F_{(C)}>4$, with $F_{(C)}=\Delta_{600}/C$, $\Delta_{600}$ being the slope to reach 90% of the viscosity developed at 600 seconds, obtained from the curve of viscosity of aqueous solution A as a function of time, at the given concentration C.

Thus, the residence time of polymer P in the unit for preparing aqueous solution A is shorter, with a lower volume of maturation preparation tank and therefore a reduced footprint within the paper mill.

More specifically, this invention relates to a method for manufacturing a sheet of paper or cardboard, comprising the addition of a water-soluble polymer P, of average molecular weight by weight greater than 750,000 Dalton, to a fibrous suspension, characterized in that it comprises the following successive steps:

preparing an aqueous solution A containing at least one water-soluble polymer P at a concentration by weight C between 0.1 and 0.5% by weight, said polymer P having a factor $F_{(C)}>4$ (strictly greater than 4), with $F_{(C)}=\Delta_{600}/C$, $\Delta_{600}$ being the slope to reach 90% of the viscosity developed by aqueous solution A at 600 seconds at 25° C., obtained from the viscosity curve of aqueous solution A as a function of time, at the given concentration C, at 25° C., polymer P being, prior to the formation of aqueous solution A, in the form of an anhydrous oily suspension containing between 20 and 60% by weight of polymer P in the form of particles of average diameter strictly less than 300 μm, the viscosity of solution A over time being determined at 25° C. using a viscometer equipped with a helical geometry, adding aqueous solution A to the fibrous suspension, in one or more injection points, forming a sheet of paper or cardboard.

In general, the viscometer equipped with a helical geometry operates on the basis of an air bearing motor driving a geometry allowing controlled shear or controlled shear stress tests.

In the remainder of the description and in the claims, all the polymer dosages expressed in $gt^{-1}$ or $kg \cdot t^{-1}$ are given by weight of active polymer per ton of dry matter. The dry matter corresponds to the dry extract obtained after evaporation of the water from the fibrous suspension used in a process for manufacturing a sheet of paper or cardboard. The dry matter is generally based on cellulosic fibers and fillers, advantageously consisting of cellulosic fibers and fillers. The term "cellulosic fibers" encompasses any cellulosic entity, including fibers, fines, microfibrils, or nanofibrils.

The term "polymer" refers to both homopolymers and copolymers.

The term, "water-soluble polymer", designates a polymer which gives an aqueous solution without insoluble particles when it is dissolved under stirring for 4 hours at 25° C. and at a concentration of 20 $g \cdot L^{-1}$, in deionized water.

According to this invention, the "average molecular weight by weight" of the water-soluble polymer is determined by measuring the intrinsic viscosity. The intrinsic viscosity can be measured by methods known to those skilled in the art and can in particular be calculated from the values of reduced viscosity for different concentrations by a graphical method consisting in plotting the values of reduced viscosity (on the ordinate axis) as a function of the concentrations (on the abscissa axis) and by extrapolating the curve to a zero concentration. The intrinsic viscosity value is plotted on the ordinate axis or using the least squares method. The molecular weight can then be determined by the celebrated Mark-Houwink equation:

$$[\eta]=KM^{\alpha}$$

where $[\eta]$ represents the intrinsic viscosity of the polymer determined by the solution viscosity measurement method, K represents an empirical constant, M represents the molecular weight of the polymer, $\alpha$ represents the Mark-Houwink coefficient, and $\alpha$ and K depend on the particular polymer-solvent system.

The term, "fibrous suspension", should be understood as thick pulp or thin pulp which is based on water and cellulosic fibers and fillers. Thick stock, with a dry matter concentration by weight greater than 1% or even greater than 3%, is upstream of the fan-pump. Thin stock, having a concentration by weight of dry matter generally lower than 1%, is located downstream of the fan pump.

Aqueous solution A of polymer P can also be referred to as a polymer stock solution P. Before its addition to the fibrous suspension, this solution A, filtered at 300 μm, shows no trace of undissolved polymer P.

The viscosity of solution A over time is determined, in water at 25° C., using a viscometer, preferably of the Thermo Scientific HAAKE iQ Air type equipped with a helical geometry.

Preferentially, polymer P is obtained from at least one water-soluble monoethylenically unsaturated monomer, most often nonionic and/or anionic and/or cationic and/or zwiterrionic preferably selected from:

at least one nonionic monomer selected from the group comprising acrylamide, methacrylamide, N-alkylacrylamides, N-alkylmethacrylamides, N,N-dialkyl acrylamides, N, N-dialkylmethacrylamides, alkoxylated esters of acrylic acid, alkoxylated esters of methacrylic acid, N-vinylpyridine, N-vinylpyrrolidone, hydroxyalkylacrylates, and hydroxyalkyl methacrylates, preferably acrylamide, at least one anionic monomer selected from the group comprising monomers having a carboxylic function and their salts including acrylic acid, methacrylic acid, itaconic acid, maleic acid; monomers having a sulphonic acid function and their salts; including acrylamido tertio butyl sulfonic acid (ATBS), allyl sulfonic acid and methallyl sulfonic acid, and their alkaline or alkaline-earth salts, and monomers having a phosphonic acid function and their salts, at least one cationic monomer selected from the group comprising quaternized or salified dimethylaminoethyl acrylate (ADAME), quaternized or salified dimethylaminoethyl methacrylate (MADAME), diallyldimethylammonium chloride (DADMAC), acrylamidopropyltrimethylammonium chloride (APTAC), and methacrylamidopropyltrimethylammonium chloride (MAPTAC), at least one zwitterionic monomer selected from the group comprising sulfobetaine monomers such as sulfopropyl dimethylammonium ethyl methacrylate, sulfopropyl dimethylammonium propylmethacrylamide, and sulfopropyl 2-vinylpyridinium; phosphobetaine monomers, such as phosphato ethyl trimethylammonium ethyl methacrylate; and carboxybetaine monomers.

For nonionic monomers, an alkyl group denotes a $C_nH_{2n+1}$ hydrocarbon group, n being advantageously between 1 and 5, more advantageously between 1 and 3.

According to the invention, "YY and/or ZZ" is meant to convey either YY, ZZ or YY and ZZ.

The water-soluble polymer P can be linear or structured. The term "structured" conveys the idea that the polymer can be in the form of a branched polymer, for example in the form of a comb or in the form of a star.

The water-soluble polymer P can further be structured by at least one structuring agent, which can be selected from the group comprising polyethylenically unsaturated monomers (i.e., having at least two unsaturated functions), such as, for example, vinyl, allyl, acrylic and epoxy functions. Mention may be made, for example, of methylene bis acrylamide (MBA), triallyamine, tetraallylammonium chloride and 1,2-dihydroxyethylene bis-(N-acrylamide).

The water-soluble polymer P can be obtained by radical polymerization according to the following polymerization techniques which are well known to those skilled in the art: gel polymerization, precipitation polymerization, inverse emulsion polymerization (optionally followed by distillation).

This polymerization is generally a free radical polymerization. According to the invention, "polymerization by free radicals", should be understood as a polymerization by free radicals by means of at least one initiator (UV, azo, redox or thermal), or else a technique of controlled radical polymerization (CRP), or a matrix polymerization technique.

Prior to the formation of aqueous solution A, polymer P is in the form of an anhydrous oily suspension, generally obtained by suspending particles of polymer P in an oil. The anhydrous character is guaranteed by not adding water.

Prior to the formation of aqueous solution A, polymer P is in the form of an anhydrous oily suspension containing between 20 and 60% by weight of polymer P in the form of particles with an average diameter strictly less than 300 μm, advantageously between 0.1 and less than 300 μm, and even more advantageously between 1 and less than 300 μm. The average diameter refers to the number average diameter of the polymer particles.

The oil of the anhydrous oily suspension of polymer P is selected from mineral oils (containing saturated hydrocarbons such as paraffins, isoparaffins or cycloparaffins) and/or synthetic oils. The oil can advantageously represent 40 to 80% by weight of the anhydrous oily suspension, for example 45 to 70%.

The anhydrous oily suspension of polymer P advantageously comprises between 20 and 60%, more preferably between 30 and 55%, by weight of water-soluble polymer P, which is advantageously in the form of particles with a lower average diameter of between 0.1 and less than 300 μm.

The particles of water-soluble polymer P in the anhydrous oily suspension have an average diameter advantageously less than 300 μm, preferentially from 0.1 to less than 300 μm and more preferentially from 1 to less than 300 μm. The average diameter of the particles can be determined by any method known to those skilled in the art, such as, for example, by binocular microscopy. Even more preferentially, the anhydrous oily suspension of polymer P may contain a rheology modifying agent and/or an emulsifying agent and/or a reversing agent. In this case, the percentage by weight of oil (advantageously 40 to 80%) is adjusted to reach, or not exceed, 100.

Thus, the anhydrous oily suspension of polymer P can consist of polymer P, of oil and of at least one additive selected from among a rheology-modifying agent, an emulsifying agent, an inverting agent and mixtures thereof.

Preferably, the rheology modifier is selected from hydroxyethylcellulose, attapulgite, laponite, hectorite, montmorillonite, bentonite, fumed silicas and mixtures thereof.

The anhydrous oily suspension of polymer P advantageously contains between 0.05 and 5.00% by weight of rheology modifier, more advantageously between 0.05 and 1.5%, even more advantageously between 0.1 and 1.0% by weight (relative to the weight of the anhydrous oily suspension).

The emulsifying agent is advantageously selected from sorbitan esters, polyethoxylated sorbitan esters, diethoxylated oleocetyl alcohol, polyesters having an average molecular weight of between 1000 and 3000 Dalton resulting from the condensation between a poly(isobutenyl) succinic acid or its anhydride and a polyethylene glycol, block copolymers with an average molecular weight of between 2500 and 3500 Dalton resulting from the condensation between hydroxystearic acid and a polyethylene glycol, ethoxylated fatty amines, derivatives of di-alkanol amides, copolymers stearyl methacrylate, and mixtures thereof.

The anhydrous oily suspension of polymer P advantageously contains between 0.5 and 5.0% by weight of emulsifying agent, more advantageously between 1.0 and 2.0% by weight (relative to the weight of the anhydrous oily suspension).

The inverting agent is advantageously chosen from ethoxylated nonylphenols, preferably having 4 to 10 ethoxylations; ethoxy and propoxylated alcohols preferably having an ethoxy/propoxylation comprising between 12 and 25 carbon atoms; ethoxylated tridecyl alcohols; ethoxy/propoxylated fatty alcohols ethoxylated sorbitan esters (advantageously 20 molar equivalents of ethylene oxide); polyethoxylated sorbitan laurate (advantageously 20 molar equivalents of ethylene oxide); polyethoxylated castor oil (advantageously 40 molar equivalents of ethylene oxide); decaethoxylated oleodecyl alcohol; heptaoxyethylated lauryl alcohol; polyethoxylated sorbitan monostearate (advantageously 20 molar equivalents of ethylene oxide); polyethoxylated alkyl phenols (advantageously 10 molar equivalents of ethylene oxide) cetyl ether polyethylene oxide alkyl aryl ether; N-ketyl-N-ethyl morpholinium ethosulfate; sodium lauryl sulfate; condensation products of fatty alcohols with ethylene oxide (advantageously 10 molar equivalents of ethylene oxide); condensation products of alkylphenols and ethylene oxide (preferably 12 molar equivalents of ethylene oxide); condensation products of fatty amines with 5 or more molar equivalents of ethylene oxide; ethoxylated tristyrylphenols; condensates of ethylene oxide with polyhydric alcohols partially esterified with fatty chains as well as their anhydrous forms; amine oxides; alkyl polyglucosides; glucamide; phosphate esters; alkylbenzene sulfonic acids and their salts; water-soluble surfactant polymers and their mixtures.

The anhydrous oily suspension of polymer P advantageously contains between 0.1 and 4.0% by weight of rheology modifier, more advantageously between 0.2 and 2.0%, by weight (relative to the weight of the anhydrous oily suspension).

Thus, the anhydrous oily suspension of polymer P may contain between 0.05 and 5.0% by weight of rheology modifier, between 0.5 and 5.0% by weight of emulsifying agent and between 0.1 and 4.0% by weight reversing agent.

The oil and any additional compounds of the anhydrous oily suspension (rheology modifying agent, emulsifying agent and reversing agent) have no effect on the development of the viscosity of the aqueous polymer solution. These compounds therefore have no effect on the $F_{(c)}$factor. Their possible presence is therefore not detrimental (and not necessary) when measuring the $F_{(C)}$ factor.

Preferentially, polymer P is introduced into the fibrous suspension at a rate of 100 to 5000 $gt^{-1}$ of dry matter (cellulosic fibers+charges).

The fibrous suspension encompasses the possible use of different fibers: virgin fibers, recycled fibers, chemical pulp, mechanical pulp, micro or nano fibrillated cellulose, with all types of fillers such as $TiO_2$, $CaCO_3$ (crushed or precipitated), kaolin, organic fillers and mixtures thereof.

The water-soluble polymer P can be used within the papermaking process in combination with other products such as inorganic or organic coagulants, dry strength agents, wet strength agents, natural polymers such as starches or carboxymethyl cellulose (CMC), inorganic microparticles such as bentonite microparticles and colloidal silica microparticles, organic polymers of any ionic nature (cationic, anionic, or amphoteric) and which can be (without being limiting) linear, branched, crosslinked, hydrophobic, or associative.

The following figures and examples illustrate the invention without however limiting its scope.

EXAMPLES OF EMBODIMENTS OF THE INVENTION

Figure 1:
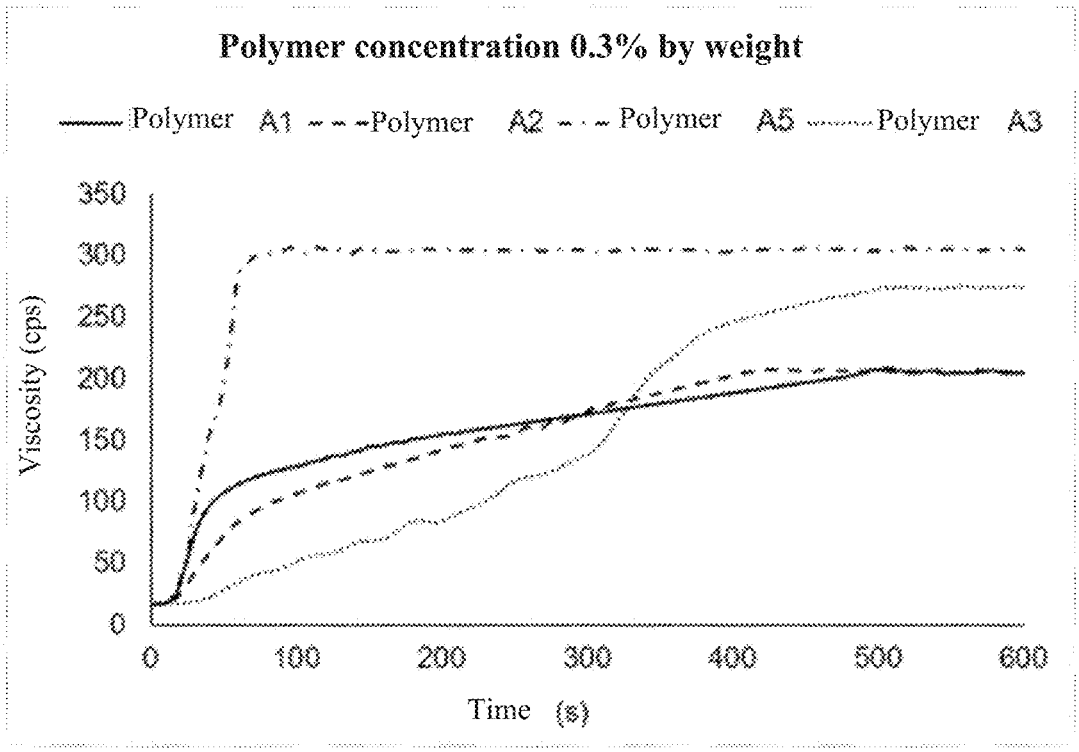
FIG. 1 shows curves of viscosity as a function of time of polymers P of different factors $F_{(c)}$.

Procedures Used in the Examples:

a) Types of Pulp Used

Virgin Fiber Pulp:

Wet pulp is obtained by disintegrating dry pulp to obtain a final aqueous concentration of 1% by weight. It is a neutral pH pulp composed, by weight, of 90% bleached virgin long fibers, 10% bleached virgin short fibers, and 30% additional GCC (ground calcium carbonate) (Hydrocal® 55 from Omya) in relation to the weight of the fibers.

Recycled Fiber Pulp:

Wet pulp is obtained by disintegrating dry pulp to obtain a final aqueous concentration of 1% by weight. It is a pH-neutral pulp made from 100% recycled cardboard fibers.

b) Assessment of Total Retention and Charge Retention

The different results are obtained through the use of a "Britt Jar" type container, with a stirring speed of 1000 revolutions per minute.

The sequence for adding the different retention agents is as follows:

T=0 s: Stirring 500 mL of pulp at 0.5% by weight

T=10 s: Optional addition of agent X

T=20 s: Optional addition of retention agent

T=30 s: Removal of the first 20 mL corresponding to the dead volume under the fabric, then recovery of 100 mL of white water The first pass retention (% FPR for "First Pass Retention"), corresponding to the total retention is calculated according to the following formula:

$$\% \text{ FPR}=(C_{HB}-C_{WW})/C_{HB}*100$$

The first pass retention of ash as a percentage (% FPAR for "First Pass Ash Retention") is calculated according to the following formula:

$$\% \text{ FPAR}=(A_{HB}-A_{WW})/A_{HB}*100$$

with:

$C_{HB}$: Consistency of the head box $C_{WW}$: Consistency of the white water $A_{HB}$: Consistency of the ashes of the head box $A_{WW}$: Consistency of the white-water ashes c) Evaluation of Gravity Drainage Performance Using the "Canadian Standard Freeness" (CSF)

In a beaker, the pulp is treated, subjected to a stirring speed of 1000 revolutions per minute.

The sequence for adding the different retention agents is as follows:

T=0 s: Stirring of 500 mL of pulp at 0.6% by weight

T=10 s: Optional addition of agent X

T=20 s: Added retention agent

T=30 s: Stop stirring and add the quantity of water necessary to obtain 1 liter.

This liter of pulp is transferred to the "Canadian Standard Freeness Tester" and the TAPPI T227om-99 procedure is applied.

The volume, expressed in mL, collected by the side pipe gives a measure of gravity dripping. The higher this value, the better the gravity drainage.

This performance can also be expressed by calculating the percentage improvement over blank (% CSF).

d) Evaluation of Drainage Performance (DDA)

The DDA ("Dynamic Drainage Analyzer") automatically determines the time (in seconds) required to drain a fibrous suspension under vacuum. The polymers are added to the wet pulp (0.6 liters of pulp at 1.0% by weight) in the DDA cylinder with stirring at 1000 rpm:

T=0 s: stirring the pulp

T=10 s: optional addition of agent X

T=20 s: addition of retention agent

T=30 s: stopping the stirring and draining under vacuum at 200 mbar (1 bar=$10^5$ Pa) for 70 s.

The pressure under the fabric is recorded as a function of time. When all the water is evacuated from the fibrous mat, the air passes through it causing a break in the slope to appear on the curve representing the pressure under the fabric as a function of time. The time, expressed in seconds, recorded at this break in slope corresponds to the drip time. The shorter the time, the better the vacuum drainage.

e) Performance in DSR Application (Dry Strength), Grammage at 90 $gm^{-2}$

The necessary quantity of pulp is removed so as to obtain in the end a sheet having a basis weight of 90 $gm^{-2}$.

The wet pulp is introduced into the vat of the dynamic molder and is kept under agitation. The different components of the system are injected into this pulp according to the predefined sequence. A contact time of 30 to 45 seconds is generally respected between each addition of polymer.

Paper formettes are produced with an automatic dynamic former: a blotter and the forming fabric are placed in the bowl of the dynamic former before starting the rotation of the bowl at 1000 $rpm^{-1}$ and building the water wall. The treated pulp is spread over the water wall to form the fibrous mat on the forming fabric.

Once the water is drained, the fibrous mat is recovered, pressed under a press delivering 4 bar, then dried at 117° C. The sheet obtained is conditioned overnight in a room with controlled humidity and temperature (50% relative humidity and 23° C.). The dry strength properties of all the sheets obtained by this procedure are then measured.

The burst is measured with a Messmer Buchel M 405 burst tester according to the TAPPI T403 om-02 standard. The result is expressed in kPa. The bursting index is determined, expressed in $kPa \cdot m^2/g$, by dividing this value by the grammage of the sheet tested.

Dry breaking length is measured in the machine direction with a Testometric AX tensile device according to TAPPI T494 om-01. The result is expressed in km.

f) Viscosity Measurement Over Time with HAAKE IQ Air

The Haake Viscometer IQ Air is a viscometer operating on the basis of an air bearing motor driving a geometry allowing controlled shear or controlled shear stress tests. With a propeller-type module, this device makes it possible to measure the viscosity deployed by the polymer during its dissolution over time. For the measurement, the polymer solution is prepared directly in the sample holder. At the end of the measurement, the data is saved and formatted via a viscosity graph=f (time).

Products Tested in the Examples:

In the following list, type A products are anionic and type C products are cationic. Type X products are high filler-dense products which can each be used, for example, as a coagulant. Product $X_1$ is inorganic in nature, while product $X_2$ is organic.

Polymer $A_1$: Water-soluble polymer composed of 30 mol % of sodium acrylate and 70 mol % of acrylamide in the form of an inverse emulsion, this emulsion comprises 29% of $A_1$, 30% of water, and 30% of oil by weight. $A_1$ has an average molecular weight of 20 million Dalton (Brookfield viscosity of 8.16 cps (applicable for all polymers below: UL modulus, 0.1%, 1M NaCl, 60 $rpm^{-1}$, 23° C.)).

Polymer $A_2$: Water-soluble polymer composed of 30 mol % sodium acrylate and 70 mol % acrylamide in the form of an oily suspension (distilled inverse emulsion). This suspension contains 50% by weight of $A_2$, 40% by weight of oil, 5% water. $A_2$ has an average molecular weight of 18 million Daltons (Brookfield viscosity of 7.76 cps).

Polymer $A_3$: Water-soluble polymer composed of 30 mol % sodium acrylate and 70 mol % acrylamide in powder form. $A_3$ has an average molecular weight of 18 million Daltons (Brookfield viscosity 7.71 cps).

Polymer $A_4$: Water-soluble polymer composed of 30 mol % sodium acrylate and 70 mol % acrylamide in powder form. $A_4$ has an average molecular weight of 5 million Daltons (Brookfield viscosity 2.21 cps).

Polymer $A_5$ (invention): Water-soluble polymer composed of 30 mol % of sodium acrylate and 70 mol % of acrylamide in the form of an anhydrous oily suspension. The average size of the polymer particles is between 1 and less than 300 μm. The oily suspension contains 55.5% by weight of polymer $A_5$, 37.5% by weight of oil, 4.5% by weight of bentonite, 2% by weight of sorbitan monooleate, and 0.5% by weight of C13 oxo ethoxylatedalcohol, $A_6$ has an average molecular weight of 18 million Daltons (Brookfield viscosity 7.71 cps).

Polymer $A_6$ (invention): Water-soluble polymer composed of 30 mol % of sodium acrylate and 70 mol % of acrylamide in the form of an anhydrous oily suspension. The average size of the polymer particles is between 1 and less than 300 μm. The oily suspension contains 52.5% by weight of polymer $A_6$, 40.5% by weight of oil, 4.5% by weight of bentonite, 2% by weight of sorbitan monooleate, and 0.5% by weight of C13 oxo ethoxylatedalcohol, $A_6$ has an average molecular weight of 5 million Daltons (Brookfield viscosity 2.21 cps).

Polymer $C_1$: Water-soluble polymer composed of 15 mol % of chloromethylated dimethylaminoethyl acrylate (ADAME) and 85 mol % of acrylamide in the form of an inverse emulsion, this emulsion containing 35% of $C_1$, 30% of water, and 30% of oil by weight. $C_1$ has an average molecular weight of 8 million Daltons (Brookfield viscosity of 4.86 cps).

Polymer $C_2$: Water-soluble polymer composed of 15 mol % of chloromethylated dimethylaminoethyl acrylate (ADAME) and 85 mol % of acrylamide in the form of an oily suspension (distilled inverse emulsion). This suspension contains 50% by weight of $C_2$, 40% by weight of oil, 5% water. $C_2$ has an average molecular weight of 8 million Daltons (Brookfield viscosity of 4.96 cps).

Polymer $C_3$: Water-soluble polymer composed of 15 mol % of chloromethylated dimethylaminoethyl acrylate (ADAME) and 85 mol % of acrylamide in powder form. $C_3$ has an average molecular weight of 9 million Dalton (Brookfield viscosity 4.96 cps).

Polymer $C_4$ (invention): Water-soluble polymer composed of 15 mol % of chloromethylated dimethylaminoethyl acrylate (ADAME) and 85 mol % of acrylamide in the form of an oily suspension (distilled inverse emulsion). The average size of the polymer particles is between 1 and less than 300 μm. The oily suspension contains 52.5% by weight of polymer $C_4$, 40.5% by weight of oil, 4.5% by weight of bentonite, 2% by weight of sorbitan monooleate, and 0.5% by weight of ethoxylated $C_{13}$ oxo alcohol. $C_4$ has an average molecular weight of 8 million Daltons (Brookfield viscosity of 4.96 cps).

Product $X_1$: Polyaluminium chloride containing 18% by weight of alumina ($Al_2O_3$).

Product $X_2$: Cationic product with a cationic charge density of 5.5 meq/g, from the Hofmann reaction on a polyacrylamide.

Factors $F_{(C)}$ of Polymers $A_n$ and $C_n$ at Different Concentrations C (in % in Weight)

TABLE 1

| Polymers $A_n$ | | | | | | | | | | | | |
|---|---|---|---|---|---|---|---|---|---|---|---|---|
| Polymer | $A_1$ | | | $A_2$ | | | $A_3$ | | | $A_4$ | | |
| Concentration (% by weight) | 0.5 | 0.3 | 0.1 | 0.5 | 0.3 | 0.1 | 0.5 | 0.3 | 0.1 | 0.5 | 0.3 | 0.1 |
| Viscosity 600 s (cps) | 427 | 205 | 96 | 343 | 206 | 83 | 389 | 274 | 119 | 142 | 78 | 51 |
| Viscosity 90% (cps) | 384 | 185 | 86 | 309 | 185 | 75 | 350 | 247 | 107 | 128 | 70 | 46 |
| Starting viscosity (cps) | 17 | 17 | 17 | 17 | 17 | 17 | 17 | 17 | 17 | 17 | 17 | 17 |
| Time 90% (seconds) | 340 | 374 | 441 | 266 | 340 | 360 | 315 | 400 | 486 | 330 | 414 | 330 |
| Factor $F_{(C)}$ | 2.16 | 1.49 | 1.57 | 2.19 | 1.65 | 1.60 | 2.11 | 1.91 | 1.85 | 0.67 | 0.43 | 0.88 |

| Polymer | $A_5$ | | | $A_6$ | | |
|---|---|---|---|---|---|---|
| Concentration (% by weight) | 0.5 | 0.3 | 0.1 | 0.5 | 0.3 | 0.1 |
| Viscosity 600 secondes (cps) | 380 | 305 | 196 | 145 | 92 | 70 |
| Viscosity 90% (cps) | 342 | 275 | 176 | 131 | 82 | 63 |
| Starting viscosity (cps) | 17 | 17 | 17 | 17 | 17 | 17 |
| Time 90% (secondes) | 54 | 58 | 93 | 50 | 52 | 90 |
| Factor $F_{(C)}$ | 12.04 | 14.80 | 17.14 | 4.54 | 4.22 | 5.11 |

TABLE 2

| $C_n$ polymers | | | | | | | | | | | | |
|---|---|---|---|---|---|---|---|---|---|---|---|---|
| Polymer | $C_1$ | | | $C_2$ | | | $C_3$ | | | $C_4$ | | |
| Concentration (% by weight) | 0.5 | 0.3 | 0.1 | 0.5 | 0.3 | 0.1 | 0.5 | 0.3 | 0.1 | 0.5 | 0.3 | 0.1 |
| Viscosity 600 s (cps) | 233 | 132 | 79 | 226 | 155 | 85 | 198 | 135 | 84 | 251 | 179 | 119 |
| Viscosity 90% (cps) | 210 | 119 | 71 | 203 | 140 | 77 | 178 | 121 | 76 | 226 | 161 | 107 |
| Starting viscosity (cps) | 17 | 17 | 17 | 17 | 17 | 17 | 17 | 17 | 17 | 17 | 17 | 17 |
| Time 90% (secondes) | 107 | 102 | 144 | 176 | 114 | 168 | 410 | 490 | 468 | 70 | 78 | 90 |
| Factor $F_{(C)}$ | 3.60 | 3.33 | 3.76 | 2.12 | 3.58 | 3.54 | 0.79 | 0.71 | 1.25 | 5.97 | 6.16 | 10.01 |

FIG. 1 represents the viscosity curves as a function of time for the polymers $A_1$, $A_2$ and $A_3$ and $A_5$ for a polymer concentration of 0.3% by weight in water.

Figure 2:
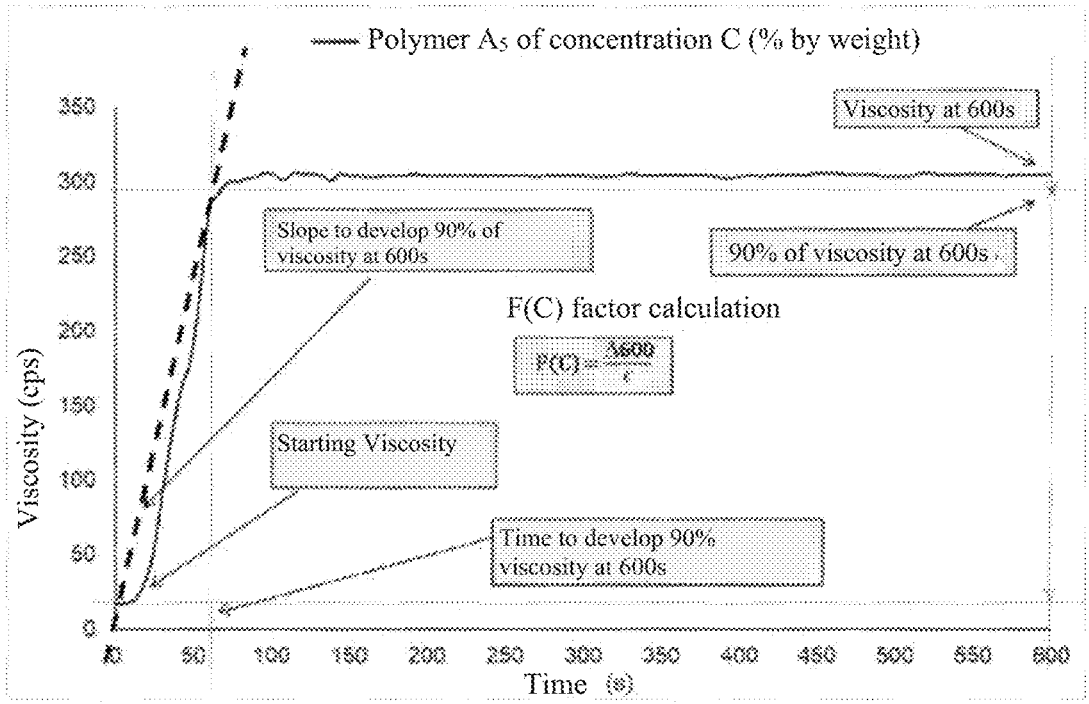
FIG. 2 represents a viscosity versus time curve of a polymer P for which the $F_{(c)}$ factor is calculated.

FIG. 2 represents the curve of viscosity as a function of time for polymer $A_5$ and details the method for calculating the factor $F_{(c)}$.

Only polymers $A_5$, $A_6$ and $C_4$ have $F_{(c)}$ factors greater than 4. They are the only ones to have reached a maximum viscosity after 600 s.

Application Tests

For all the following tests, the polymer solutions are prepared at the desired concentration (0.1%, 0.3%, or 0.5% by weight). After 2 minutes of preparation, the polymer solutions are filtered through a 300 μm filter. If the filter is covered with polymer particles, the application test is not carried out (NA: Not Applicable). The filtrates are used directly for the application tests.

CSF Performance, Retention and Filler Retention

TABLE 3

| CSF, retention and filler retention | | | | | | | | | |
|---|---|---|---|---|---|---|---|---|---|
| | % CSF 2 min 0.5% | % CSF 2 min 0.3% | % CSF 2 min 0.1% | % FPR 2 min 0.5% | % FPAR 2 min 0.5% | % FPR 2 min 0.3% | % FPAR 2 min 0.3% | % FPR 2 min 0.1% | % FPAR 2 min 0.1% |
| blank | — | — | — | 65.4 | 2.9 | 65.4 | 2.9 | 65.4 | 2.9 |
| $C_2$ (0.25 kg/t) | 40.4 | 34.9 | 30.8 | 79.7 | 35.3 | 78.2 | 32 | 77.1 | 29.4 |
| $C_1$ (0.25 kg/t) | 38.8 | 34.3 | 32.1 | 79.2 | 33.5 | 78 | 30.9 | 77.4 | 29.6 |
| $C_4$ (0.25 kg/t) | 41.7 | 41.3 | 40.4 | 80 | 35.3 | 79.9 | 35.2 | 79.6 | 34.5 |
| $C_3$ (0.25 kg/t) | NA | NA | NA | NA | NA | NA | NA | NA | NA |
| $X_1$ (0.25 kg/t) $A_2$ (0.2 kg/t) | 31.7 | 26.0 | 21.8 | 74.8 | 25.8 | 73.7 | 23 | 72.8 | 20.9 |
| $X_1$ (0.25 kg/t) $A_1$ (0.2 kg/t) | 33.3 | 32.4 | 28.8 | 75.1 | 26.5 | 74.9 | 26 | 74.2 | 24.3 |
| $X_1$ (0.25 kg/t) $A_5$ (0.2 kg/t) | 48.7 | 45.2 | 40.1 | 78.3 | 34.7 | 77.6 | 33 | 76.6 | 30.4 |
| $X_1$ (0.25 kg/t) $A_3$ (0.2 kg/t) | NA | NA | NA | NA | NA | NA | NA | NA | NA |

DDA Performance and Mechanical Resistance

TABLE 4

| DDA and mechanical strengths | | | | | | | | | |
|---|---|---|---|---|---|---|---|---|---|
| | % DDA 2 min 0.5% | % DDA 2 min 0.3% | % DDA 2 min 0.1% | % DBL SM 2 min 0.5% | % Burst index 2 min 0.5% | % DBL SM 2 min 0.3% | % Burst index 2 min 0.3% | % DBL SM 2 min 0.1% | % Burst index 2 min 0.1% |
| blank | — | — | — | — | — | — | — | — | — |
| $X_2$ (1 kg/t) | 35.9 | 35.9 | 35.6 | 10.1 | 8.6 | 10.6 | 8.8 | 10.3 | 8.6 |
| $X_2$ (1 kg/t) $A_6$ (1 kg/t) | 62.0 | 60.8 | 58.5 | 19.6 | 19.8 | 18.7 | 17.8 | 15.5 | 15.7 |
| $X_2$ (1 kg/t) $A_4$ (1 kg/t) | NA | NA | NA | NA | NA | NA | NA | NA | NA |

For all the application tests, the best performances are obtained with polymers $A_5$, $A_6$ and $C_4$ which have factors $F_{(c)}$ higher than 4. They show the importance of the form of the polymer (anhydrous oily suspension) beforehand when it is put into solution and of the factor $F_{(c)}$ in order to improve the properties of drainage, retention and the mechanical properties of the sheet of paper or cardboard.

The invention claimed is:

1. A method for making a paper or cardboard sheet, comprising, during a papermaking or cardboard sheet making process, adding a water-soluble polymer P of weight average molecular weight greater than 750,000 Daltons to a fiber suspension, wherein the method comprises the following successive steps: —preparing an aqueous solution A containing at least one water-soluble polymer P at a concentration C comprising between 0.1 and 0.5% by weight, said polymer P having a factor F(c) greater than 4, with $F(c)=A_{600}/C$, $A_{600}$ being the slope to reach 90% of the viscosity developed by aqueous solution A at 600 seconds at 25° C., obtained from the viscosity curve of aqueous solution A as a function of time, at the given concentration C, at 25° C., polymer P being, prior to the formation of aqueous solution A, in the form of an anhydrous oily suspension containing between 0.05 and 5.0% by weight of a rheology modifier and between 20 and 60% by weight of polymer P in the form of particles with a mean diameter of less than 300 μm, the viscosity of solution A over time being determined at 25° C. with the aid of a viscometer equipped with a helical geometry, —adding aqueous solution A to the fibrous suspension, and —forming a sheet of paper or cardboard using the fibrous suspension after aqueous solution A has been added thereto.

2. The method according to claim 1, wherein polymer P is a polymer of at least one water-soluble monoethylenically unsaturated monomer selected from: —at least one nonionic monomer selected from the group consisting of acrylamide, methacrylamide, N-alkylacrylamides, N-alkylmethacrylamides, N,N-dialkyl acrylamides, N,N-dialkylmethacrylamides alkoxylated esters of acrylic acid, alkoxylated esters of methacrylic acid, N-vinylpyridine, N-vinylpyrrolidone, hydroxyalkylacrylates and hydroxyalkyl methacrylates, —at least one anionic monomer selected from the group comprising monomers having a carboxylic function and their salts, including acrylic acid, methacrylic acid, itaconic acid, maleic acid monomers having a sulfonic acid function and their salts, including acrylamido tertiary butyl sulfonic acid (ATBS), allyl sulfonic acid and methallyl sulfonic acid, and their alkali or alkaline earth salts, and monomers having a phosphonic acid function and their salts, —at least one cationic monomer selected from the group consisting of quaternized or salified dimethylaminoethyl acrylate (ADAME); quaternized or salified dimethylaminoethyl methacrylate (MADAME), diallyldimethylammonium chloride (DADMAC), acrylami dopropyltrimethylammonium chloride (APTAC), and methacrylami dopropyltrimethylammonium chloride (MAPTAC), —and/or at least one zwitterionic monomer selected from the group consisting of sulfobetaine monomers, phosphobetaine monomers, and carboxybetaine monomers.

3. The method according to claim 1, wherein the anhydrous oily suspension of polymer P comprises between 30 and 55% by weight of water-soluble polymer P.

4. The method according to claim 2, wherein:

the at least one nonionic monomer, where present, comprises acrylamide; and the at least one zwitterionic monomer, where present, comprises sulfopropyl dimethylammonium ethyl methacrylate, sulfopropyl dimethylammonium propylmethacrylamide, sulfopropyl 2-vinylpyridinium, or phosphato ethyl trimethylammonium ethyl methacrylate.

5. The method according to claim 1, wherein the rheology modifying agent is selected from hydroxyethylcellulose, 1 attapulgite, laponite, hectorite, montmorillonite, bentonite, fumed silicas and mixtures thereof.

6. The method according to claim 1, wherein the anhydrous oily suspension of polymer P contains between 0.5 and 5.0% by weight of the rheology modifier.

7. The method according to claim 1, wherein the anhydrous oily suspension of polymer P contains between 0.5 and 5.0% by weight of an emulsifying agent selected from sorbitan esters, polyethoxylated sorbitan esters, diethoxylated oleocetyl alcohol, polyesters having an average molecular weight of between 1000 and 3000 Dalton resulting from the condensation between a poly (isobutenyl) succinic acid or its anhydride and a polyethylene glycol, block copolymers with an average molecular weight of between 2500 and 3500 Dalton resulting from the condensation between hydroxystearic acid and a polyethylene glycol, ethoxylated fatty amines, derivatives of di-alkanol amides, copolymers stearyl methacrylate, and mixtures thereof.

8. The method according to claim 1, wherein the anhydrous oily suspension of polymer P of contains between 0.1 and 4.0% by weight of the rheology modifier.

9. The method according to claim 1, wherein the anhydrous oily suspension of polymer P contains between 0.1 and 4.0% by weight of a reversing agent selected from ethoxylated nonylphenols; ethoxy and propoxylated alcohols; ethoxylated tridecyl alcohols; ethoxy/propoxylated fatty alcohols; ethoxylated sorbitan esters; polyethoxylated sorbitan laurate; polyethoxylated castor oil; decaethoxylated oleodecyl alcohol; heptaethoxylated lauryl alcohol; polyethoxylated sorbitan monostearate; polyethoxylated alkyl phenol cetyl ether; polyethylene oxide alkyl aryl ether; N-ketyl-N-ethyl morpholinium ethosulfate; sodium lauryl sulfate; condensation products of fatty alcohols with ethylene oxide; condensation products of alkylphenols and ethylene oxide condensation products of fatty amines with 5 or more molar equivalents of ethylene oxide; ethoxylated tristyryl phenols; condensates of ethylene oxide with polyhydric alcohols partially esterified with fatty chains and their anhydrous forms amine oxides; alkyl polyglucosides; glucamide; phosphate esters; alkylbenzene sulfonic acids and their salts; water-soluble surfactant polymers and mixtures thereof.

10. The method according to claim 1, wherein polymer P is introduced into the fibrous suspension at a rate of 100 to 5000 $gt^{-1}$ of dry matter.

11. The method according to claim 1, wherein polymer P is linear or structured.

12. The method according to claim 1, wherein polymer P of the anhydrous oily suspension is in the form of particles with an average diameter of between 0.1 μm and less than 300 μm.

13. The method according to claim 1, wherein polymer P of the anhydrous oily suspension is in the form of particles with an average diameter of between 1 μm and less than 300 μm.

14. The method according to claim 1, wherein the oil of the anhydrous oily suspension of polymer P is selected from mineral oils and/or synthetic oils.

15. The method according to claim 1, wherein the oil represents 40 to 80% by weight of the anhydrous oily suspension of polymer P.

16. The method according to claim 2, wherein the anhydrous oily suspension of polymer P comprises between 30 and 55% by weight of water-soluble polymer P.

17. The method according to claim 16, wherein the rheology modifier is selected from hydroxyethylcellulose, attapulgite, laponite, hectorite, montmorillonite, bentonite, fumed silicas and mixtures thereof.

18. The method according to claim 17, wherein the anhydrous oily suspension of polymer P contains between 0.5 and 5.0% by weight of an emulsifying agent selected from sorbitan esters, polyethoxylated sorbitan esters, diethoxylated oleocetyl alcohol, polyesters having an average molecular weight of between 1000 and 3000 Dalton resulting from the condensation between a poly (isobutenyl) succinic acid or its anhydride and a polyethylene glycol, block copolymers with an average molecular weight of between 2500 and 3500 Dalton resulting from the condensation between hydroxystearic acid and a polyethylene glycol, ethoxylated fatty amines, derivatives of di-alkanol amides, copolymers stearyl methacrylate, and mixtures thereof.

19. The method according to claim 18, wherein the anhydrous oily suspension of polymer P contains between 0.1 and 4.0% by weight of a reversing agent selected from ethoxylated nonylphenols; ethoxy and propoxylated alcohols; ethoxylated tridecyl alcohols; ethoxy/propoxylated fatty alcohols; ethoxylated sorbitan esters; polyethoxylated sorbitan laurate; polyethoxylated castor oil; decaethoxylated oleodecyl alcohol; heptaethoxylated lauryl alcohol; polyethoxylated sorbitan monostearate; polyethoxylated alkyl phenol cetyl ether; polyethylene oxide alkyl aryl ether; N-ketyl-N-ethyl morpholinium ethosulfate; sodium lauryl sulfate; condensation products of fatty alcohols with ethylene oxide; condensation products of alkylphenols and ethylene oxide condensation products of fatty amines with 5 or more molar equivalents of ethylene oxide; ethoxylated tristyryl phenols; condensates of ethylene oxide with polyhydric alcohols partially esterified with fatty chains and their anhydrous forms amine oxides; alkyl polyglucosides; glucamide; phosphate esters; alkylbenzene sulfonic acids and their salts; water-soluble surfactant polymers and mixtures thereof.

20. The method according to claim 19, wherein polymer P of the anhydrous oily suspension is in the form of particles with an average diameter of between 0.1 μm and less than 300 μm.

* * * * *